United States Patent [19]

Abplanalp

[11] 4,396,152

[45] Aug. 2, 1983

[54] AEROSOL DISPENSER SYSTEM

[76] Inventor: Robert H. Abplanalp, 10 Hewitt Ave., Bronxville, N.Y. 10708

[21] Appl. No.: 263,407

[22] Filed: May 14, 1981

Related U.S. Application Data

[63] Continuation of Ser. No. 104,533, Dec. 17, 1979, abandoned, and a continuation of Ser. No. 831,270, Sep. 7, 1977, abandoned, which is a continuation-in-part of Ser. No. 773,549, Mar. 2, 1977, abandoned.

[51] Int. Cl.[3] ..... B65D 83/14

[52] U.S. Cl. ..... 239/337; 222/402.18; 222/402.24; 239/405

[58] Field of Search ..... 239/307, 308, 337, 340, 239/403, 405, 492; 222/394,402.1, 402.18, 402.24, 402.25

[56] References Cited

U.S. PATENT DOCUMENTS

| | | | |
|---|---|---|---|
| 3,148,127 | 9/1964 | Marsh | 239/337 X |
| 3,389,837 | 6/1968 | Marand | 239/307 X |
| 3,705,667 | 12/1972 | Blanie et al. | 222/402.1 X |
| 4,020,979 | 5/1977 | Shay et al. | 239/492 X |
| 4,061,252 | 12/1977 | Riccio | 222/402.18 |

*Primary Examiner*—Andres Kashnikow

*Attorney, Agent, or Firm*—Davis, Hoxie, Faithfull & Hapgood

[57] ABSTRACT

An aerosol spray dispenser system for use with a container having both product and propellant under pressure and in vapor and liquid phases, including a valve unit in which there are separate product and propellant passages, preferably valved by a single gasket, leading from the container to an impact mixing chamber disposed within the valve unit. Here streams of liquid and propellant impact one another to form a fine dispersion of vapor in liquid which is then discharged. Preferably a venturi constriction is disposed in one of the passages just upstream of the mixing chamber. In certain embodiments the chamber and venturi are disposed in the valve housing or in the valve stem; in others they are disposed in the valve actuator contiguous to the discharge orifice; and in still other embodiments they or either of them may be in both locations.

16 Claims, 19 Drawing Figures

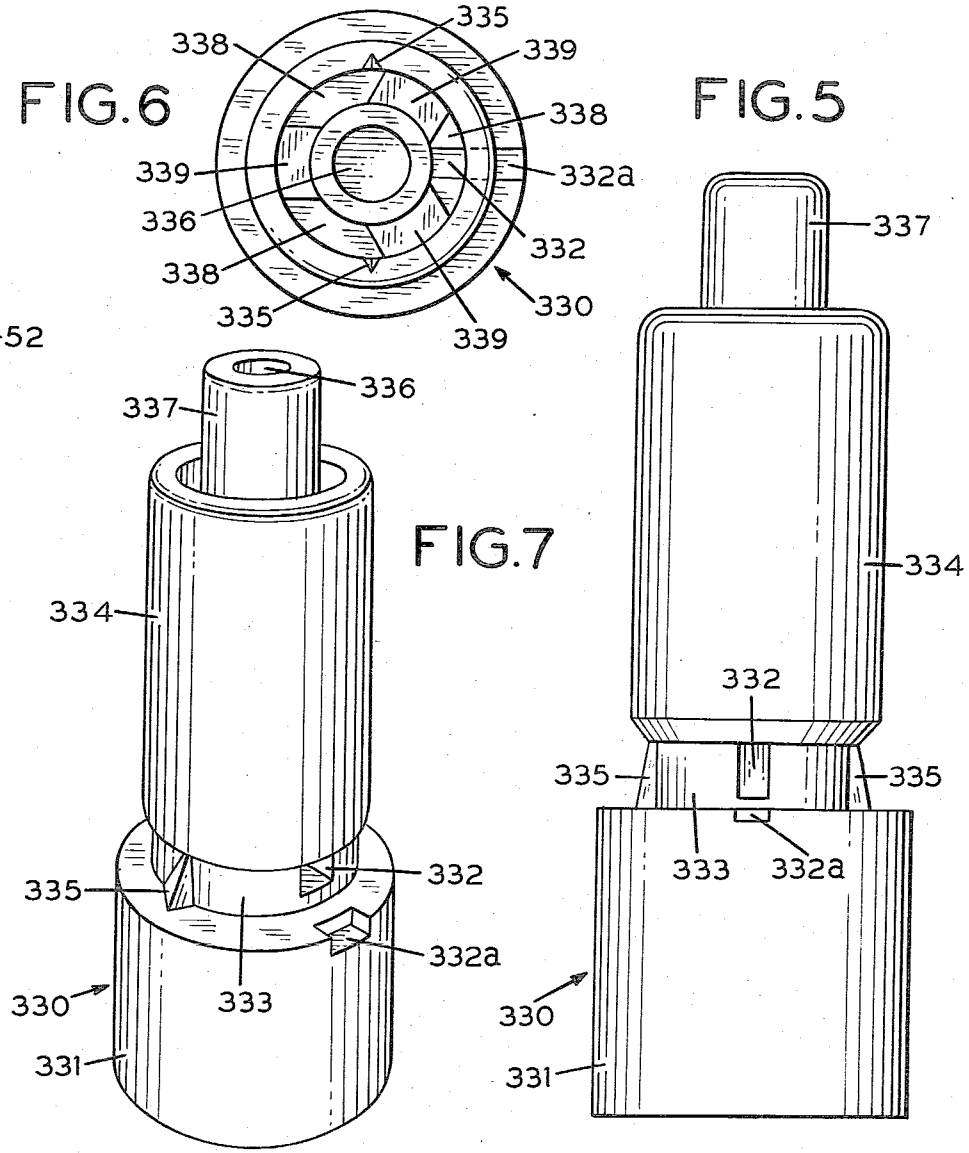
FIG.5
FIG.6
FIG.7
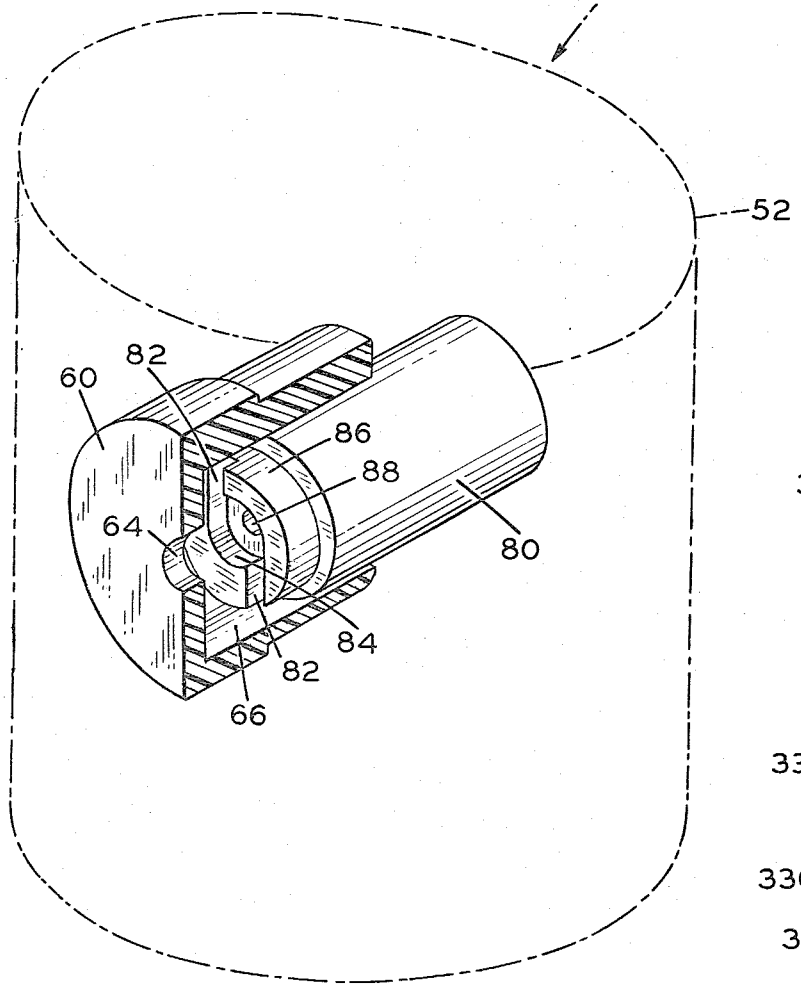
FIG.3

AEROSOL DISPENSER SYSTEM

This application is a continuation of Ser. No. 104,533, filed Dec. 17, 1979, now abandoned, and a continuation of Ser. No. 831,270, filed Sept. 7, 1977, now abandoned, which, in turn, is a continuation-in-part of Ser. No. 773,549 filed Mar. 2, 1977, now abandoned.

BACKGROUND

The most successful aerosol dispenser systems for spray application of products heretofore have been systems in which the propellant is present in a gaseous and liquid phase and the liquid propellant is commingled with the liquid product when under pressure in the container either by being miscible or soluble with or emulsified in the liquid product. The propellant is chosen to be one which rapidly vaporizes at ambient conditions. The static pressure provided by the propellant in the container forces the solution or emulsion of propellant and product through a discharge orifice when the dispensing valve is opened. At the discharge orifice the propellant rapidly vaporizes as the stream issues thereby assisting in breaking the stream into fine droplets of product which are essentially free of residual propellant.

The most common propellants used in spray systems are compounds of the chlorofluorocarbon type (hereafter fluorocarbons). Of late, these materials have been the focus of an environmental controversy regarding the adverse effect that said materials may have on the ozone depletion of the atmosphere. Because of the uncertainty of the impact of fluorocarbons on the so-called ozone layer, the aerosol industry must contend with the possible elimination of or a reduction in the reliance upon these materials as useable propellants. While non-fluorocarbon liquid propellants are available, namely, certain hydrocarbons such, for example, as propane butane and isobutane, their use with solvent-based products, such as alcohol, have presented flammability problems. These flammability problems can be alleviated by the use of aqueous systems, with the propellant present as a separate liquid phase or as an emulsion, but prior dispensing systems of that type require high percentage of propellant and have not provided the desired spray characteristics. The problem has to do with large and uneven droplet size and an unacceptably slow drying rate. Thus, in a system wherein the propellant and product are essentially immiscible there is a pressing need for a dispenser that will produce a spray having characteristics similar to that achieved by soluble propellant product systems.

In systems employing an insoluble propellant, resort has been made to mechanical means for effecting a break-up for finer dispersion of the product. For example, a common mechanical means is the disposition of a chamber at or near the discharge orifice to centrifugally swirl the product before discharge. Also, dispensing valves having vapor taps or ports in communication with the propellant vapor present in the head space of the container serve to assist the mechanical break-up by introducing propellant vapor into the product stream prior to entering the swirl chamber. In the case of insoluble systems, generally, the spray characteristics such as small droplet size, uniformity of distribution, and pattern of a mechanically created spray are inferior to those of a soluble system spray.

Another approach to dispensing products as a fine dispersion under conditions such that the propellant is not soluble in the product, is to employ the venturi principle, as shown in my U.S. Pat. Nos. 3,326,469 and 3,437,272. Product and propellant are kept in separate containers, with the product stored under atmospheric pressure and the propellant at a different but considerably higher pressure. A stream of propellant gas, by virtue of the Bernoulli effect, creates a vacuum which draws the product to a venturi device where the product stream is sheared into droplets as it meets the propellant stream. Such venturi spray devices can give many acceptable spray characteristics, but the handicap of such venturi spray devices is the need to keep product and propellant in different containers, making the handling of product and system more complicated for producers and customers. There are no known valved aerosol dispensers providing simultaneous and separate release of product and propellant from a single container to a dispersing outlet, wherein the product and propellant are in contact within the container; and further wherein the valve and actuator are disposed in or contiguous to the container closure member.

SUMMARY OF THE INVENTION

The present invention provides a single container aerosol spray dispenser wherein the product and propellant may be immiscible and wherein the spray characteristics are satisfactory. The present invention makes practical the use of inexpensive hydrocarbon propellants such as butane, isobutane and propane and permits the spray dispensing of aqueous product formulations with spray qualities at least equalling those of the soluble systems of the past. Flammable propellants can be used safely to dispense aqueous products since the flammability is obviated by the presence of water in the spray. Further, the ratio of propellant to product required for excellent spray quality is greatly reduced, effecting cost savings when compared with soluble systems. For example, common hairsprays require a weight of fluorocarbon propellant equal to that of the other components of the formulation, whereas, according to the present invention a weight of propellant 1/5 to 1/10 the weight of the other components of the formulation can be employed with equivalent spray qualities. From the exterior, the aerosol dispenser of the present invention looks and operates the same as the soluble system aerosol dispensers with which the consumer is familiar. Further, its design is such as to permit the use of existing equipment for filling.

While the present invention has application to systems wherein the liquid propellant and product are mutually soluble or emulsifiable, and it is expected that the application of the present invention to such systems would enhance the spray characteristics of the discharged product, the invention has its most needed application in systems wherein the propellant is immiscible in the liquid product, and, in particular and with added significance, in a system wherein the propellant is immiscible and the product is water-based.

In its broadest aspect the invention comprises a valve unit having a valve and actuator mounted in reciprocal relation such that movement of one produces a substantially corresponding movement of the other for dispensing a liquid product in aerosol form from a single container by means of a propellant, both propellant and product being under pressure in the container, in which the valve unit includes an impact mixing chamber, means, including dimensionally fixed conduits, for supplying separately and simultaneously high velocity streams of liquid and propellant to said chamber to form a fine dispersion of gas in liquid in said chamber, and means for discharging the preformed dispersion from said valve unit. Preferably the valve unit includes separate product and propellant conduits or passages leading from the container to the impact mixing chamber. The interior of the mixing chamber is unobstructed by valving or other elements and is so arranged that the high velocity jet streams entering the chamber will impinge upon one another, penetrating and shattering each other (by impact, shear or a combination of impact and shear, depending on the entrance angles and relative positions of the streams into the chambers) thus forming a fine dispersion of gas in liquid. One of the conduits or passages leading to the chamber preferably has a venturi constriction, which, combined with the chamber, forms a venturi ejector. In addition to promoting the impact effect the venturi constriction, by creating a vacuum effect, permits a lower propellant vapor pressure to be employed. In the preferred form of the invention, a swirl or vortical flow pattern sets up in the mixing chamber which effects a rapid and thorough commingling of product and propellant.

More specifically, the invention includes a valve unit for dispensing a liquid from a container by means of a gaseous propellant under pressure in said container, said valve unit comprising a valve body having discharge conduit means and a valve actuator in combination with an impact mixing chamber in the discharge path of liquid and gaseous propellant, and means for feeding high velocity unobstructed streams of liquid and gas simultaneously and separately to said chamber upon operation of the valve actuator to cause impingement of one of said streams upon the other, thereby to generate a fine dispersion of one phase in the other in said chamber.

In accordance with the invention the impact mixing chamber is preferably part of a venturi ejector and one of the streams is fed into the chamber preferably in an axial direction, through a venturi constriction. Also in accordance with a preferred embodiment the other stream is introduced tangentially to create a swirling or vortical flow pattern in the chamber. The valve unit has a discharge orifice from which the streams, after mixing in the mixing chamber, are ejected as a fine dispersion.

The invention further comprises a pressurized aersol spray dispenser comprising a container for containing liquid and propellant under pressure, and a valve unit as described. Preferably the liquid is aqueous in nature and the propellant is a hydrocarbon.

In a preferred embodiment the mixing chamber is fed by either the propellant or product through a central passage or conduit and the other is fed through an annular passage which surrounds the first passage.

The impact mixing chamber and the venturi ejector of which it may be a part may be positioned in the valve actuator or in the valve body or in the valve stem or there may be a chamber in the actuator and another at any position within the valve.

As noted the mixing chamber may be located within the actuator. However, surprisingly it was found that a chamber located within the valve will produce very acceptable sprays. Therefore, in one embodiment of the present invention, the chamber is placed in the valve housing, a location which does not require that the separate propellant and product passages be valved. This does permit the use of any existing valve by simply attaching the venturi mixing chamber to it, making manufacturing rather easy. Whereas the chamber may be placed in the form of a plug into the lower portion of the housing, normally receiving the dip tube, a further embodiment forsees to position it inside the valve housing.

In still a further embodiment the chamber is placed within the valve stem directly in the area of the valve seal. Although this arrangement requires separate valved passages for product and propellant, such passages may be terminated within the valve seal area. In all embodiments there is sufficient residual propellant in the dispersion to purge the passages on the downstream side of the valve and thus prevent caking or drying of the product in the discharge passages.

In order to provide a convenient and efficient means for moving propellant and product from the container in which both are present under equal pressure, the invention provides in the preferred form a valve unit comprising a valve housing which contains a single moveable cored-out valve body, and a single annular resilient valve gasket and a spring to bias the valve body upwardly toward closure. The valve body may comprise a valve stem having a central passage surrounded by an annular passage and a neck having a smaller diameter than the stem, the neck having a transverse orifice in communication with the annular passage of the stem and another orifice in communication with the central passage of the stem, and further, the valve body may have an off-center axial orifice in communication with the cored-out portion and the valve stem. The neck of the valve body is encompassed by the inner periphery of the annular gasket, enabling the gasket to close all three orifices and to be deflected away from them when the valve body is depressed against the action of the spring.

In one embodiment the neck can be provided with suitable means such as ridges, for isolating the product and propellant orifices from one another when the gasket is deflected. In a second and preferred embodiment, the separation is not achieved by mechanical means, but by placing the gaseous propellant orifice and the axial off-center orifice in the shoulder of the valve body as proximate as feasible to the respective transverse orifices intended for the product and gaseous propellant discharge. To control the amount of propellant, a propellant flow throttle device is provided on the outer wall of the valve body in the form of ribs, flanges and/or apertures.

Valve design and the design and location of the ejector unit and the impact mixing chamber may vary as will be seen from the following description. Best results are obtained when the mixing chamber is set up to give a vortical flow pattern to one of the fluid streams and when the other stream is injected through a venturi constriction axially of the vortex flow pattern.

In the description below the invention is set out in conjunction with an immiscible propellant/product system. Three separate stratified phases are present in a container in contact with one another, i.e., propellant vapor, liquid propellant, and liquid product. The liquid phase of the propellant is usually less dense than the liquid product and the mutually insoluble propellant and product liquid phases stratify in the container with the propellant floating on top of the product.

In the drawings:

FIG. 1 is an elevational view in section of a valve and actuator according to a first embodiment of the invention, FIG. 2 is an elevational view in section of a valve and actuator according to a second embodiment of the invention, FIG. 3 is an isometric view in partial section, exploded for clarity, of the inner parts of the actuator used in some embodiments and further shows the actuator in phantom outline, FIG. 4 is an elevational view in section of a valve and actuator according to a third embodiment of the invention, FIG. 5 is an elevational view of the valve body of FIG. 4, FIG. 6 is a top view of the upper end of the valve body of FIG. 5, FIG. 7 is an isometric view of the valve body of FIG. 5, and FIG. 8 is an elevational view in section of a valve and actuator according to a fourth embodiment of the present invention.

Figure 1:
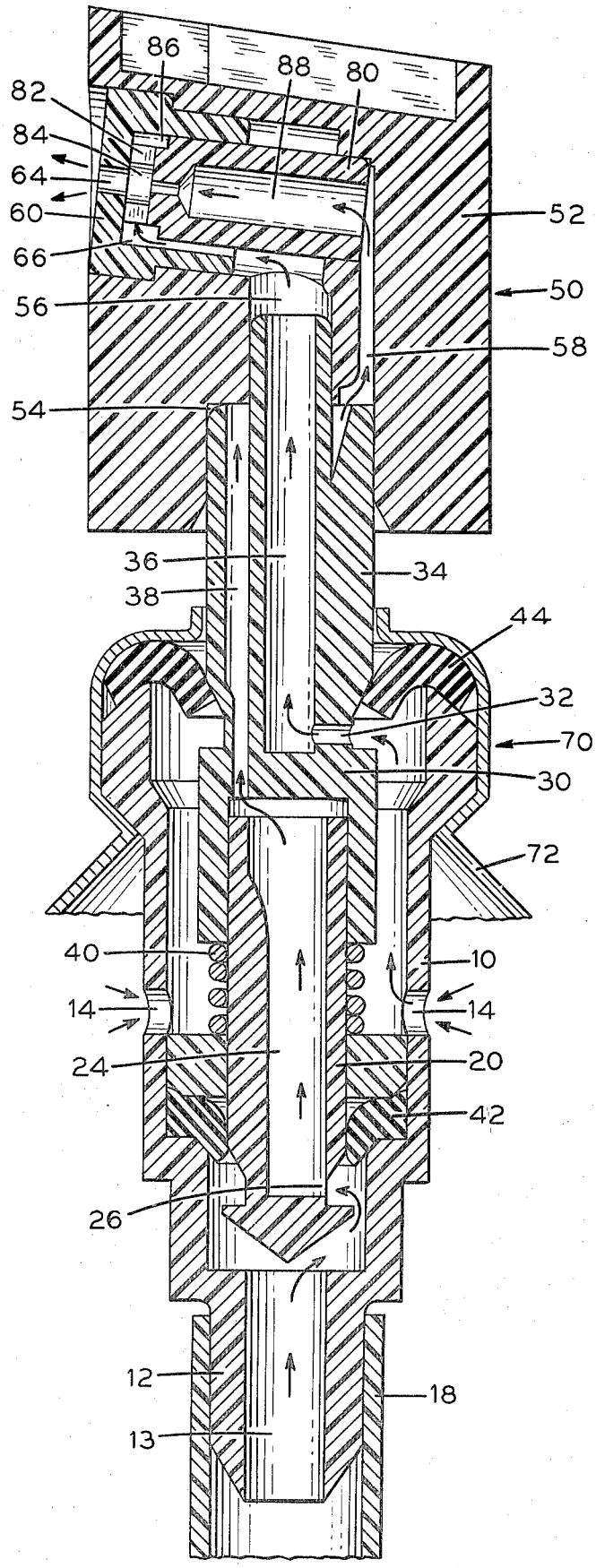

FIG. 1 shows an opened discharge valve unit comprising a valve and actuator assembly according to a first embodiment of the present invention. The valve is a double valve having separate product and propellant passageways which are opened upon depression of the actuator. The valve housing 10 is affixed to the pedestal portion 70 of a conventional valve mounting cup by crimps 72. The valve mounting cup (an element of the container closure) is affixed to the mouth of a vessel or container which holds the supply of product and propellant, in any conventional way, thus providing a closure for the vessel or container. A typical aerosol container and closure structure is shown, for example, in U.S. Pat. No. 3,735,955. The valve housing 10 has a product eduction tube 18 frictionally fitted to an inlet nipple 12 at the bottom and has propellant inlet ports 14 extending through the sidewall of the housing. A vertically moveable valve body assembly is formed in two pieces; a lower valve body member 20 and an upper valve body member 30. The valve body assembly is biased upwardly toward closure by a compression spring 40. The upper valve body member 30 is integral with a valve stem 34 which extends through an aperture in the pedestal 70 of the mounting cup and upon which the actuator button 50 is frictionally fitted. The valve stem 34 includes a central passage 36 concentrically surrounded by an annular passage 38.

The lower valve body member 20 includes a central passage 24 in communication with the annular passage 38 of the upper valve body member 30. The lower valve body 20 includes a transverse valve orifice 26 which is blocked by an annular resilient gasket 42 when the valve is closed and is exposed, as shown, when the valve is actuated by depression of the actuator 50 against the bias of spring 40.

The upper valve body 30 includes a transverse valve orifice 32 which is blocked by a second annular resilient gasket 44 when the valve is closed and is exposed, as shown, when the valve is actuated.

The actuator 50, further shown in FIG. 3, is in the form of a button having a body 52 provided with a valve stem receiving socket 54 on its lower face for frictional retention of the actuator on the valve stem 34. The body 52 includes a first passage 56 in communication with the central passage 36 of the valve stem 34 and a second passage 58 in communication with the annular passage 38 of the valve stem. A two piece insert 60, 80 is frictionally fitted in the actuator body. The inner insert member 80 is concentrically surrounded by the outer insert member 60. A passage 88 having a constricted portion in its downstream end extends axially of the cylindrical inner insert member and terminates coaxially of the discharge orifice 64 of the outer member 60. Passage 88 is in communication with passage 58 of the actuator body 52. A groove in the inner wall of the outer insert member 60 forms a passage 66 in communication with passage 56 of the actuator body 52. An annular rabbet is formed in the end of insert member 80 to form an annular chamber 86 when the inner and outer insert members 80, 60 are assembled. Annular chamber 86 is in communication with passage 66. An impact mixing chamber 84 formed in the end face of inner insert member 80 is in communication with the annular chamber 86 through a plurality of grooves 82 in the end face of insert 80 which grooves extend tangentially of the circular periphery of chamber 84 and intercept the annular chamber 86. At the entrance to chamber 84 the grooves 82 thus have a wall of the chamber on either side and directly opposite to them. The passage 88 terminates centrally of the rear wall of the chamber 84. Discharge orifice 64 commences centrally of the front wall of the chamber 84.

The relationship of the configuration of the end of inner insert member 80 with the outer insert member 60 is shown in the isometric view of FIG. 3 wherein the tangential deployment of grooves 82 extending between annular chamber 86 and the chamber 84 is apparent.

In operation, depression of actuator button 50 causes the moveable valve body 30, 20 of FIG. 1 to move downwardly against the bias of spring 40 to open the valves by causing deflection of the resilient gaskets 42, 44 to expose valve orifices 26, 32. A product path is established extending from the product in the container through eduction tube 18, through the inlet passage 13 of the nipple 12, and through the exposed valve orifice 26 into the passage 24 in the lower valve body 20. The product ascends passage 24 and enters the annular passage 38 of the upper valve member 30. The product then enters passage 58 of the actuator and enters the axial passage 88 of the inner insert member 80. It passes through the venturi constriction at the downstream end of passage 88, and into impact mixing chamber 84. The chamber 84, being in communication with the atmosphere through discharge orifice 64, is at a lower pressure than the interior of the container holding product and propellant. Concurrently, valve orifice 32 of the upper valve member 30 is opened to establish a propellant vapor path extending from the head space of the container through ports 14 into the interior of valve housing 10. Propellant vapor passes through the open valve orifice 32 and travels upwardly through the central passage 36 of the valve stem 34 to passage 56 of the actuator body 52. The propellant travels through passage 66 to the annular chamber 86. The propellant then travels through tangential passages 82 to enter chamber 84 tangentially to swirl about in chamber 84. Here it is impacted by the product stream from the venturi constriction. The venturi ejector action occasioned by the relative dimensions and positioning of the product and the propellant exits imparts greater velocity to the issuing or discharge stream than would be imparted by internal container pressure alone. The issuing propellant, having been spun in the swirl chamber continues to spin as it impacts with product. The mixture of finely dispersed propellant and product thus moves to discharge orifice 64, and emerges therefrom in a conical spray pattern.

Figure 2:
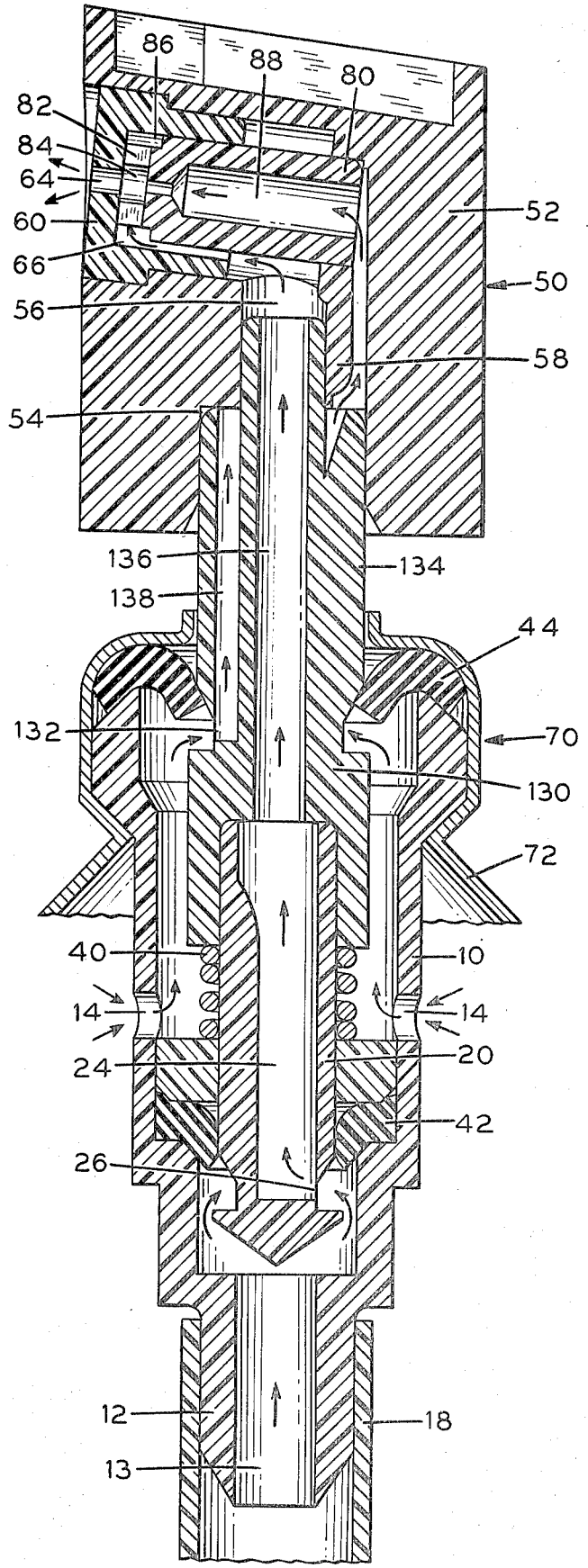

FIG. 2 shows a second embodiment similar to that of FIG. 1, but with the product and propellant interchanged in the actuator passages. Parts which are identical with those of the embodiment of FIG. 1 bear the same numbers. Parts which are modified bear the number of their counterparts with one hundred added.

To interchange the product and propellant in the actuator 50, the structure of the upper valve body 130 is changed. Valve stem central bore 136 is in communication with the central passage 24 of the lower valve body 20. Valve stem annular passage 138 is in communication with upper valve orifice 132. The actuator 50 and lower valve remain unchanged.

The operation of the embodiment of FIG. 2 is similar to that of FIG. 1 but with reversed flow stream. Upon depression of the actuator 50 against the bias of spring 40 product flows up the eduction tube 18, through the lower valve orifice 26, up passage 24, through passage 136 of the valve stem 134 and into actuator passages 56, 66 to the impact mixing chamber 84 and out the discharge orifice. Propellant flows through housing ports 14 and through upper valve orifice 132 into the annular passage 138 of the valve stem 134 into actuator passages 58, 88 to issue through the discharge orifice 64. Since the product enters the chamber 84 through tangential passages 82, the product spins as it issues from the discharge orifice 64 whereby centrifugal force acts to break the emergent stream into a fine spray. The velocity of the propellant issuing from the constricted passage 88 interior of the discharge orifice 64 causes a reduction in pressure at the annular exit of the chamber 84 to further accelerate the product. The impact of the high velocity propellant and product on one another and the centrifugal force acting on the product all serve to divide the product into a fine dispersion of uniform size and even distribution.

FIGS. 4–7 illustrate a third embodiment of the present invention in which a one piece valve body, shown in detail in FIGS. 5–7, serves to separately valve the product and propellant by a single gasket. The actuator 50 is identical to that of the embodiments of FIGS. 1 and 2 and bears the same part numbers.

The valve body 330 shown in FIGS. 4–7 is integral with a valve stem 334 having a central passage 336 surrounded by an annular passage 338. Three radial ribs 339 in the annular passage 338 support the inner tubular portion 337 which includes the central passage 336. A first valve orifice 326 communicates with passage 336 and, when opened, is in communication through opening 341 with the product eduction tube 318. A second valve orifice 332 is located diametrically opposite the first valve orifice 326. The second orifice 332 is in communication with the annular passage 338 and, when opened, is in communication with the interior of the housing 310 which is open to propellant vapor in the head space of the container through propellant ports 314.

Figure 4:
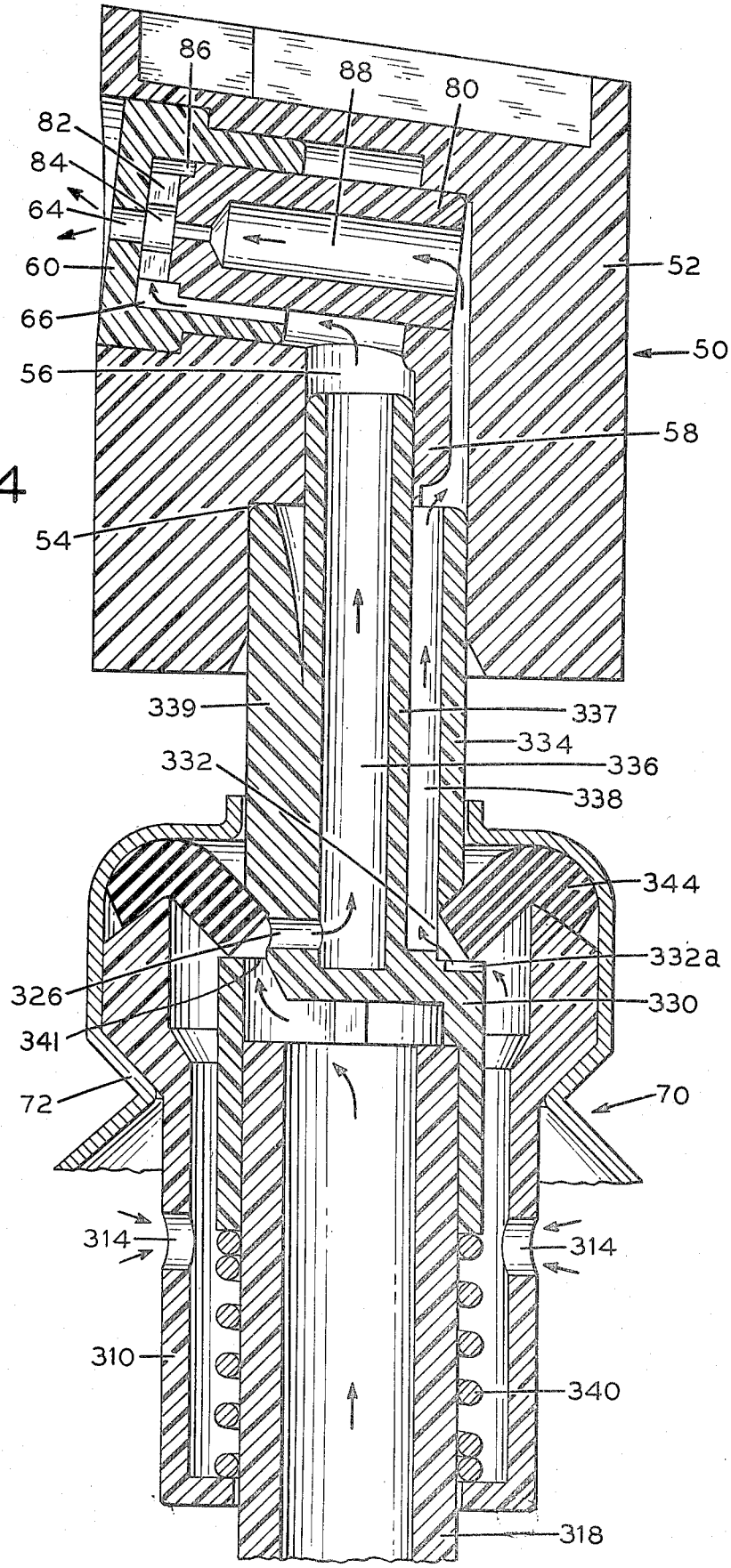

FIG. 5 shows the exterior configuration of the valve body 330 as would be seen looking from right to left in FIG. 4. Between the valve stem portion 334 and the enlarged lower portion 331 of body 330 is a reduced diameter neck portion 333 which is encompassed by the periphery of the central aperture of the annular resilient gasket 344 to seal the first and second valve orifices 336, 332 when the valve is closed. A pair of ridges or ribs 335 of V shape bite into the periphery of the central aperture of the gasket 344 to form seals which keep the product separate from the propellant when the gasket is deflected to peel the gasket aperture periphery away from the first and second valve orifices 336, 332 when the valve is opened as is shown in FIG. 4. Ribs 335 divide the annular separation between the gasket aperture periphery and the neck 333 into a pair of semi-circular spaces, one for each valve orifice. A shallow groove **332*a* on the top of body portion 331 in alignment with the second valve orifice 332 assures a path for propellant past the inner edge of the gasket 344 when the valve is opened as is shown in FIG. 4**.

The operation of the embodiment of FIGS. 4–7 is similar to that of the embodiment of FIG. 2. Depression of actuator 50 causes the moveable valve body 330 to move downwardly against the bias of spring 340 thereby deflecting the periphery of the central aperture of annular gasket 344 away from valve orifice 326 to open a product path extending from the product eduction tube, through orifice 326 and through valve stem passage 336 to actuator passage 56. Concurrently the gasket is moved away from valve orifice 332 to establish a propellant path extending from the container through the port 314 of the housing 310 through the orifice 332, and through valve stem annular passage 338 to actuator passage 58. The operation of the actuator is identical with that described in connection with FIG. 2.

Figure 8:
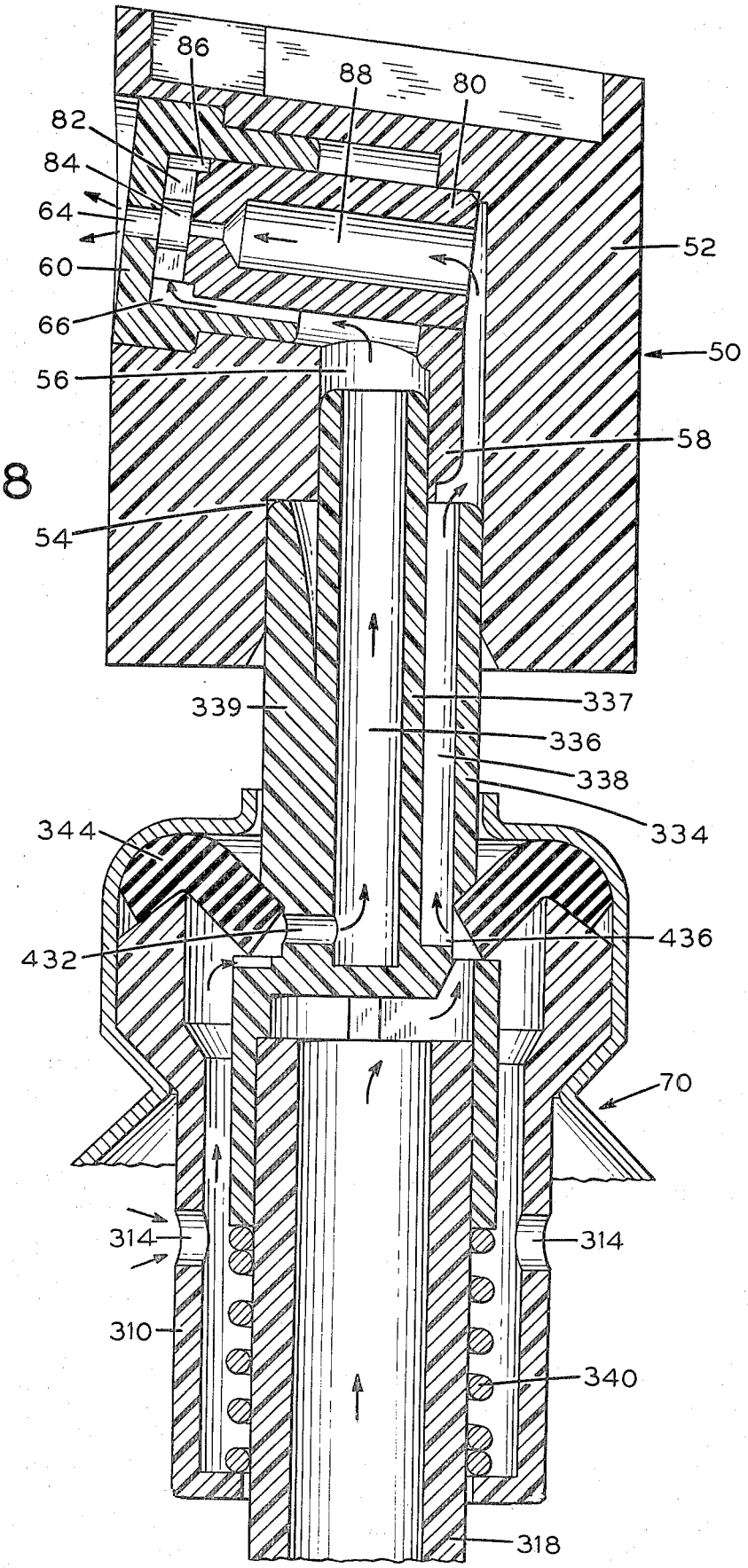

FIG. 8 shows an embodiment similar to that of FIGS. 4–7, but with the product and propellant passages interchanged. The actuator 50 remains unchanged. In this embodiment valve orifice 432 is arranged to supply propellant to central passage 336 of the valve stem 334 and valve orifice 436 is arranged to supply product to the annular passage 338 of the valve stem 334 with the result of product in actuator passage 58 and propellant in actuator passages 66, 86, 82, 84 such that the product is surrounded by propellant as was the case with the embodiment of FIG. 1.

Figure 9:
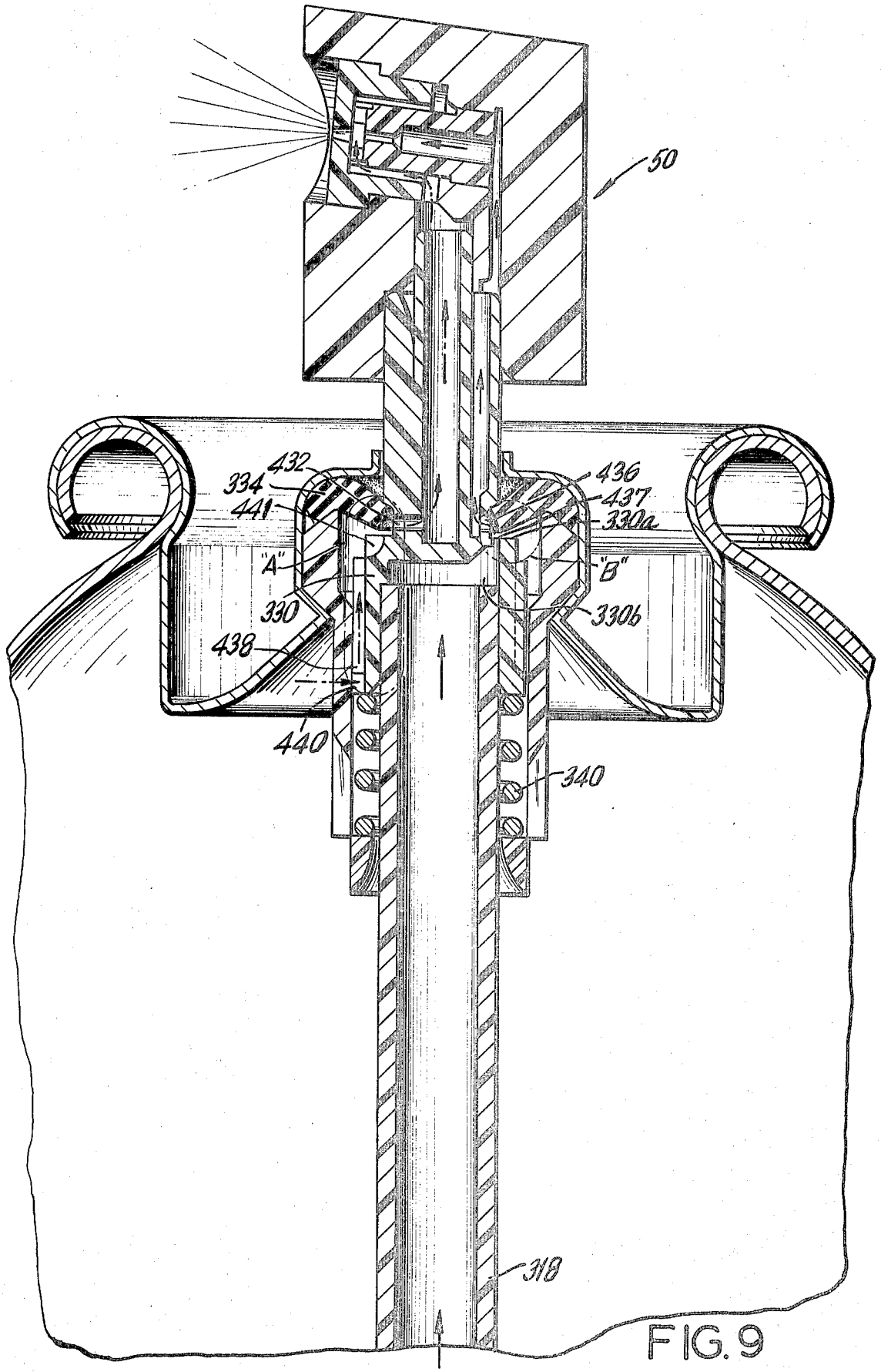
FIG. 9 is an elevational view in section of modifications of the embodiment of FIG. 8.

FIG. 9 shows the embodiment of FIG. 8, but with modifications to the valve body and stem. The actuator 50 remains unchanged as do the other components of the valve unit except where noted hereafter. In this modification the ridges or ribs 335 (shown in FIGS. 5–7) are not present. Also note that when the valve is in open position the gasket 334 need not engage the top shoulder 330*a* of the valve body 330.

The exterior wall of the valve body 330 has spaced vertical guide posts 438 which extend from an annular flange 439 located on the bottom of the exterior wall of the valve body 330. Located in the flange 439 in substantial vertical alignment with the groove 441 and the valve stem orifice 432 is the throttling opening 440. The opening 437 in the top shoulder 330*a* of the valve body 330 is located proximate to the orifice 436 in the valve stem and is in communication through interior passage 330*b* with the product eduction tube 318.

Figure 10:
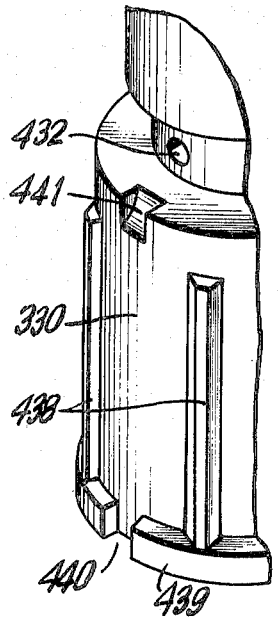
FIG. 10 is an enlarged perspective view of the wall of the valve body and valve stem as shown within the ellipsoid designation "A" of FIG. 9.
Figure 11:
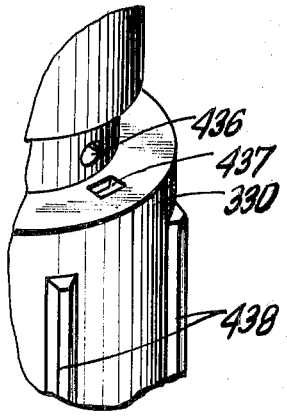
FIG. 11 is an enlarged perspective of the valve body and valve stem shown within the circular designation "B" of FIG. 9.

The details of the aforedescribed modifications are best shown in FIG. 10 and 11.

Upon actuation of the valve unit of FIG. 9, it has been found that the gaseous propellant and liquid product will pass without substantial commingling through the valve stem orifice contiguous to the respective passage of propellant and product within the valve stem since the throttling effect of the opening 440 balances the gaseous and liquid pressures at the gasket 334.

Figure 12:
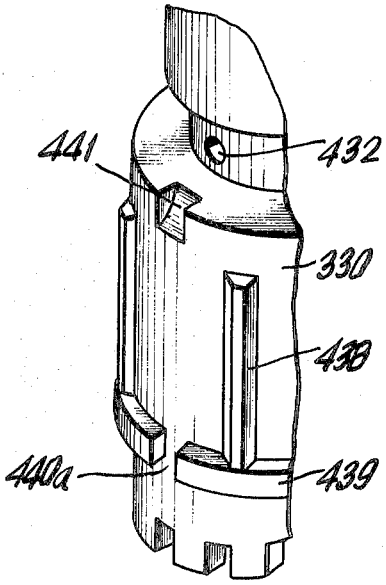
FIG. 12 is an enlarged perspective of a further modification of the embodiment of FIG. 8.

In a further modification shown in FIG. 12, the flange 439 is moved upward of the lower end of the valve body. The lower edge of the valve body extending beneath the flange may be castellated or otherwise shaped to provide a surface to abut the spring 340 and yet permit free flow of gaseous propellant around the spring even if the spring shifts laterally. The control of the flow of the gaseous propellant is effected through the opening 440*a* in the flange 439, as in the embodiment shown in FIG. 9.

It should be understood that the modifications of FIGS. 9–12 can be readily adapted to the system of FIG. 4 wherein the product and propellant flow through the valve stem are reversed.

FIGS. 13–16 shows an embodiment in which an impact mixing chamber effecting a venturi action is disposed in the bottom of the valve housing.

Figure 13:
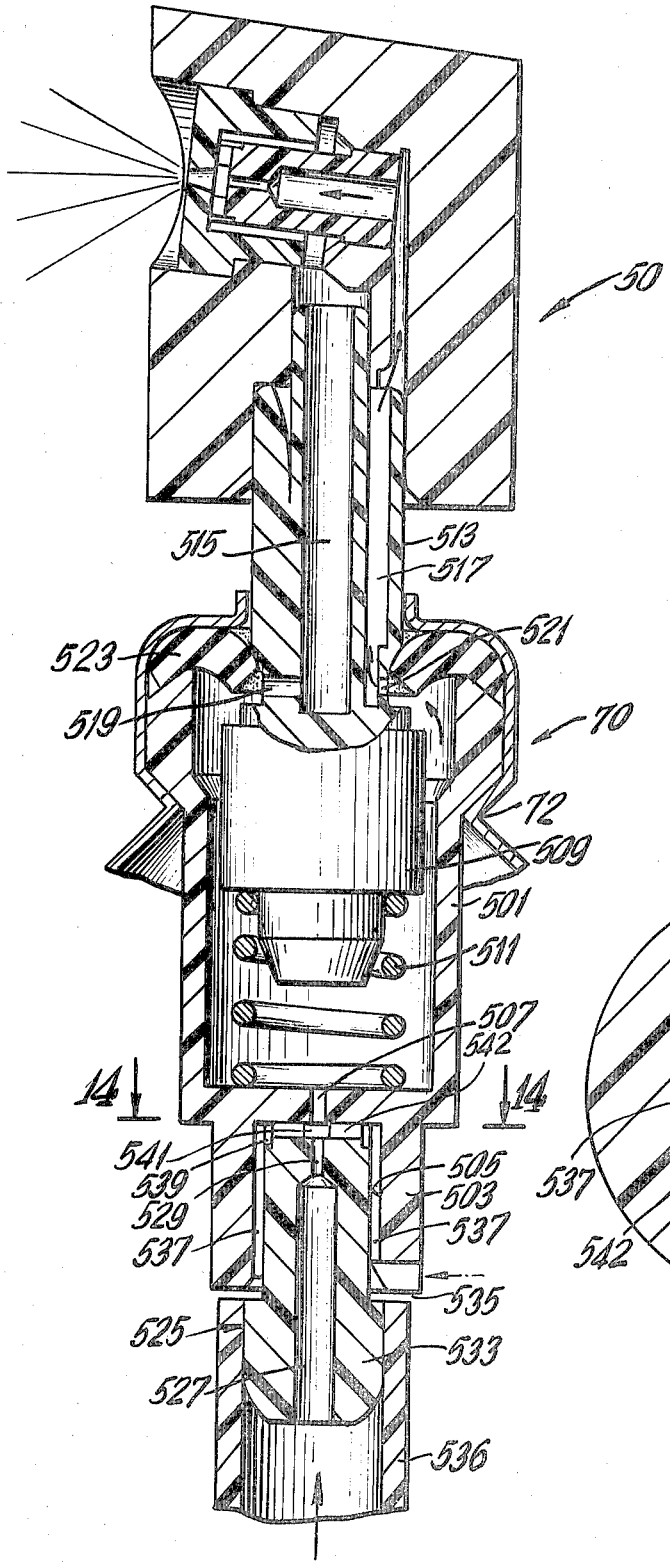
FIG. 13 is an elevational view in section of a valve and actuator according to a fifth embodiment of the present invention.

In FIG. 13 the actuator 50 is constructed as in the earlier embodiments. The valve housing 501 is affixed to the pedestal portion 70 of a conventional mounting cup by crimps 72. The valve housing 501 has a hollow nipple 503 which defines a recess 505. Extending through the bottom wall of the housing 501 is an opening 507. A vertically moving valve body 509 is biased upwardly toward closure by a compression spring 511. The valve body 509 is integral with a valve stem 513 which extends through an aperture in the pedestal 70 of the mounting cup and upon which the actuator 50 is frictionally fitted. The valve stem 513 includes a central passage 515 concentrically surrounded by an annular passage 517. The valve stem 513 has transverse orifices 519 and 521 which communicate with the central passage 515 and the concentric annular passage 517, respectively.

The orifices 519 and 521 are obturated by the resilient gasket 523 when the valve is in closed position and are both open to flow therethrough when the valve is in the actuated or open position.

In the recess 505 is friction fitted an impact mixing chamber in the form of plug member 525. Plug member 525 has a central opening 527 terminating in a venturi constriction 529, which empties into an impact mixing chamber. The plug member 525 has a knob portion 533 which is exterior to the recess 505 and is shaped to receive, in friction-fit relationship, the product dip tube 536.

The knob portion 533 of the plug member 525 is spaced from the end of the walls of the recess 505 to provide an annular spacing 535. The interior wall of the nipple 503 has several vertical grooves 537 extending its length, the grooves 537 communicating interiorly with an annular groove 539 in the top portion of the plug member 525 interiorly and the opening 535 exteriorly of the recess.

Figure 14:
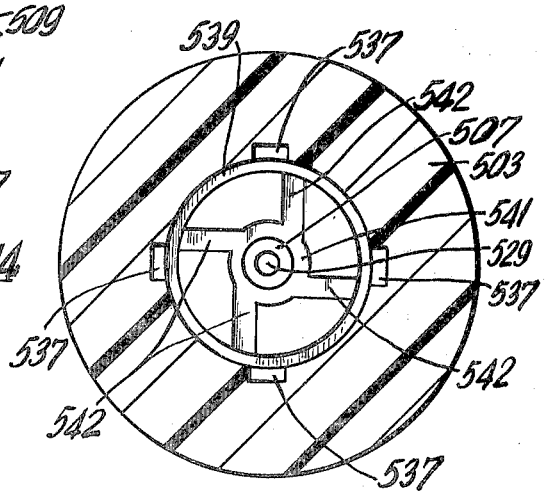
FIG. 14 is a plan sectional view along the line 14—14 of FIG. 13.

The top surface of the plug member 525 is best shown in FIG. 14. Nipple 503 has grooves 537. The grooves 537 communicate with the annular groove 539 in plug member 525. From the annular groove or passage 539 extends transverse grooves or passages 542, which passages 542 connect to the impact mixing chamber 541. The opening 507 in the bottom of housing 501 acts as a discharge orifice from the chamber 541.

In operation, depression of the actuator button 50 causes the moveable valve body 509 to move downwardly against the bias of spring 511 to open the orifices 519 and 521 by causing deflection of the resilient gasket 523. Upon opening of the valve, gaseous propellant passes successively through the openings and passages 535, 537, and 542 to the mixing chamber 541. The pressure in the mixing chamber 541, which was substantially that in the entrance prior to actuation is substantially lowered as the chamber is put into communication with the atmosphere through the valve body 509, orifices 519 and 521 passages 515 and 517 and actuator 50. In the mixing chamber 541, the swirling gaseous propellant impacts product entering the chamber through the dip tube 535 and the venturi constriction 529 in the plug member 503, and forms a fine dispersion of gas in liquid. The dispersion passes through the opening 507, through the interior of the valve housing 501 and then through the orifices 519 and 521 to the passages 515 and 517 in the valve stem 513.

As shown in FIG. 13, the admixed propellant and product pass through an actuator 50 having an additional impact mixing chamber as that described in the plug member 533.

It should be noted, as shown in FIG. 14, that each of the grooves 542 is disposed such that an extension thereof intercepts the chamber 541 in an off-center spatial relation, causing a vortical or swirling motion therein.

Figures 15, 16, 17:
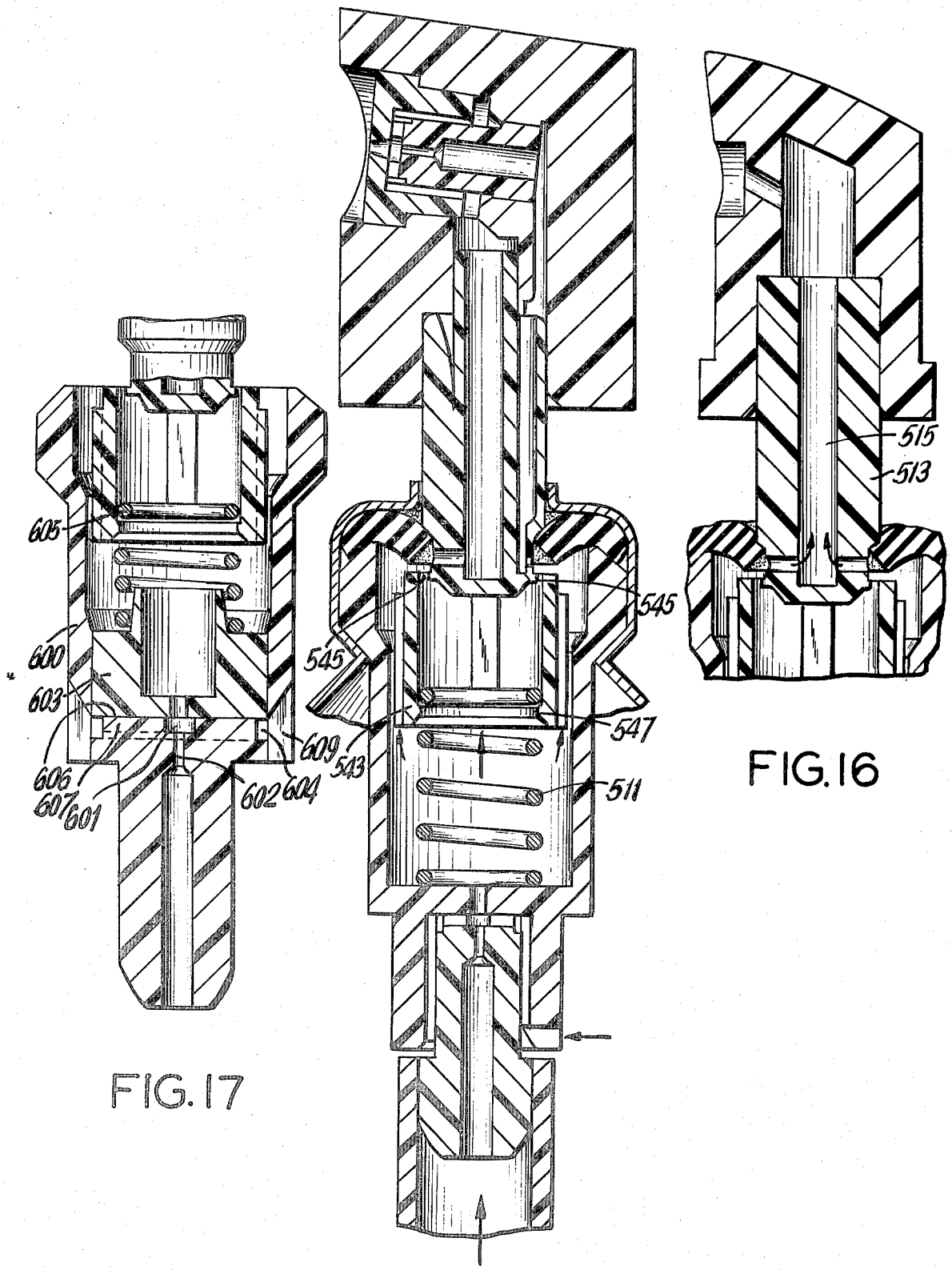
FIG. 15 is an elevational view in section of a modification of the valve body and spring of the embodiment of FIG. 13.
FIG. 16 is a partial elevational view in section of a modification of the embodiment of FIG. 15.
FIG. 17 is a view in elevation, partly cut away of a further modification of the embodiments of FIGS. 13-16.

FIG. 15 is the same as the embodiment of FIG. 13, except that the valve body 543 is a hollow inverted cup-like member. A plurality of openings 545 are provided in the shoulder 545*a* of the valve body 543 to facilitate flow of the admixed gaseous propellant and product to the valve stem orifices and passages. The spring 511 is held by the annular bead 547.

FIG. 16 is the same as the embodiment of FIGS. 13 and 15 except that the valve stem 513 has a single passage 515, which may be fitted with any conventional aerosol spray actuator.

A further embodiment of the subject invention, shown in FIG. 17, is to dispose the impact mixing chamber 601, inside the valve housing 600. As in FIG. 15, the housing has a central aperture 602 with a venturi constriction for product feed into the chamber 601. The chamber 601 and its feed passages are defined by the bottom wall 606 of the housing and a disc-like member 603 abutting the bottom wall of the housing. The bottom wall 606 is cut out to form the mixing chamber 601 transverse passages 607 and an annular recess 604 patterned like those in FIG. 14. Openings 609 for feeding the gas propellant to the annular recess and thence to the transverse passages are in the bottom wall outside the product feed passage 602. A spring 605 is positioned atop the disc-like member 603 and during actuation forces the disc member against the inner bottom wall of the housing.

Disposing the impact mixing chamber inside the container precludes drying or other adverse change of the product in the discharge passages of the unit. Inside the container side the product in the passages is in the environment of the container contents and thus will not dry and is not exposed to atmospherically induced changes. After the valve is closed any residue of propellant-product mix residing in the atmosphere side of the valve port will be purged from swirl passages due to the force generated by the expanding propellant.

Figure 18A:
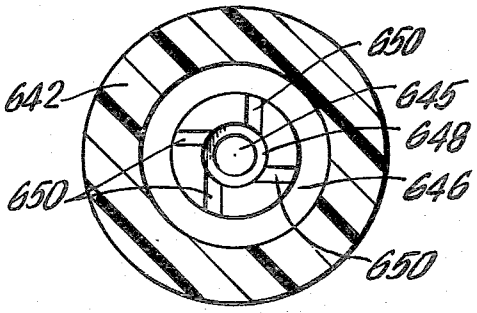
FIG. 18*a* is an under sectional view along the line 18*a*—18*a* of FIG. 18.
Figure 18:
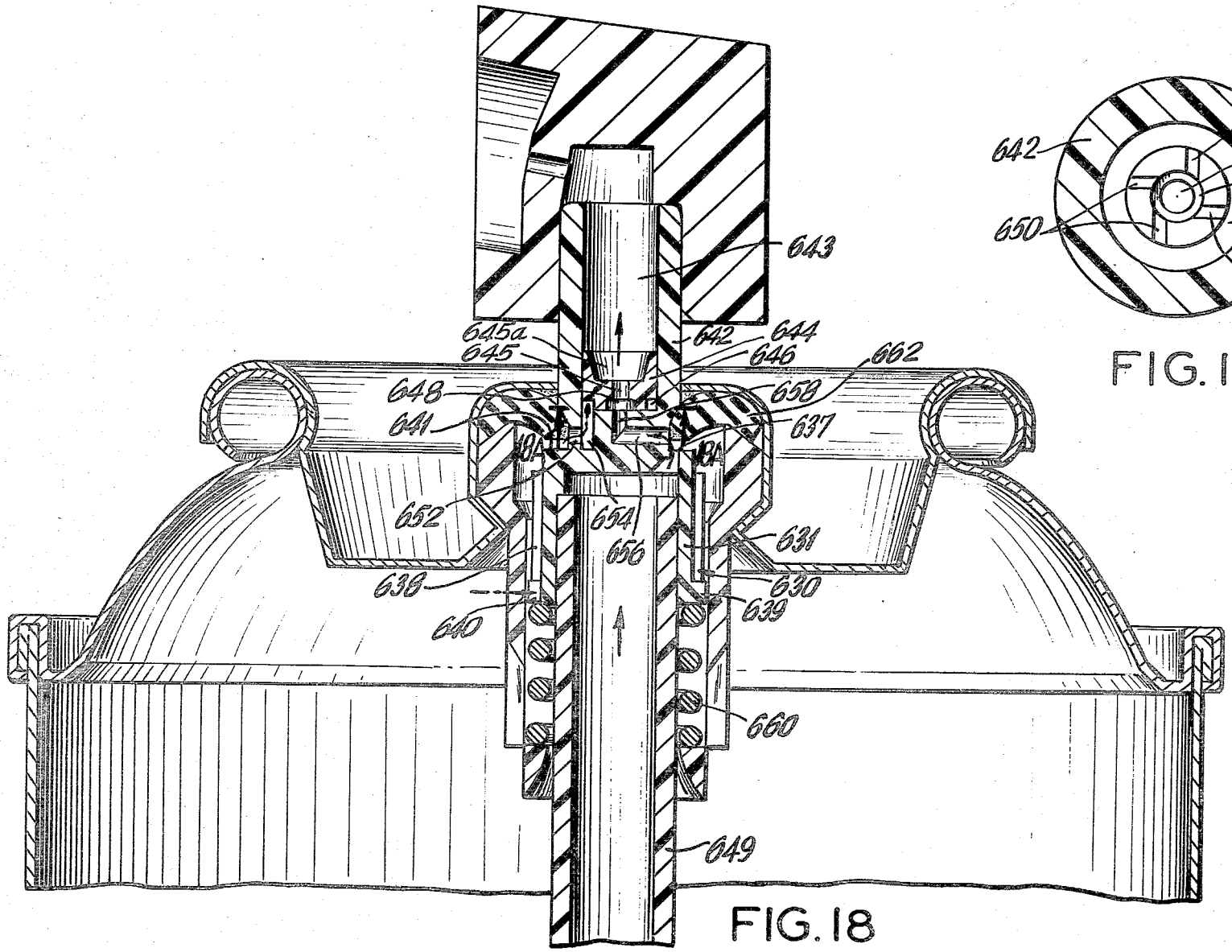
FIG. 18 is an elevational view in section of a valve and actuator according to a sixth embodiment of the present invention.

FIGS. 18 and 18*a* show a further embodiment of the invention wherein the impact mixing chamber is disposed in the lower region of the valve stem. In FIG. 18 the lower portion 631 of the valve body 630 is similar to that of FIG. 9, having a flange 639 with a slot or opening 640 for the passage of gas through the flange. Splines or guide posts 638, are also provided, as are grooves 641 in the shoulder of the valve body. An opening 637 is also provided in the shoulder of the valve body, communicating with the product eduction tube 649.

The valve body of FIG. 18 has a stem 642 that has a central bore 643 into which is placed an insert 644. The insert 644 has a central conduit 645 and 645*a*. The bottom face of the insert 644 has an annular groove 646, a centrally disposed mixing chamber 648 and transverse grooves 650, each of which 646, 648 and 650 are best shown in FIG. 18*a*. Proximate to the groove 641 in the shoulder of the valve body is lateral conduit 652 and vertical conduit 654, the upper end of the latter communicating with the annular grove 646. The opening 637 in the shoulder of the valve body communicates with the lateral conduit 656, which conduit 656 communicates at one end with the axially central conduit 658, said conduit 658, communicating at the other end with the mixing chamber 648. The valve stem 642 having a single central bore 643 may be fitted with any conventional aerosol spray actuator.

In opertion, depression of the actuator button causes the movable valve body 632 to move downwardly against the bias of the spring 660 to open the conduits 652 and 656 by causing deflection of the resilient gasket 662. Upon opening of the valve, gaseous propellant passes successively through the opening 640, the groove 641, the lateral conduit 652 and the vertical conduit 654, the annular and the transverse grooves 646 and 650, respectively to the mixing chamber 648. In the mixing chamber 648, the swirling gaseous propellant impacts product entering the chamber through the dip tube 650 and the venturi constriction or axial central conduit 658, and forms a fine dispersion of gas in liquid. The dispersion passes through the central conduit 645, 645*a*, through the central bore 643 of the valve stem 642 to the discharge orifice.

I claim:

1. A valve unit for a pressurized aerosol dispenser having a container for containing under pressure a liquid product and a propellant, said unit comprising a valve housing which contains a single moveable valve body, and a single annular resilient valve gasket and a spring to bias the valve body upwardly toward closure, the valve body comprising a valve stem having a central passage surrounded by an annular passage and a neck of smaller diameter than said stem portion, said neck portion having a first transverse valve orifice in communication with said annular passage of the valve stem and a second transverse valve orifice remote from the first and in communication with the central passage of the valve stem, said neck portion being encompassed by the inner periphery of the annular gasket to close both valve orifices when the valve body is in the closed position and to be deflected away from both valve orifices when the body is depressed against the bias of the spring.

2. The valve unit of claim 1, wherein said neck portion including a pair of ridges, each intermediate the first and second valve orifices, said ridges extending radially outwardly of said neck portion into constant contact with the inner periphery of the gasket to isolate the first valve orifice from the second orifice when the valve body is depressed to open the valve unit.

3. The valve unit of claim 1, and comprising means for furnishing propellant vapor from a container to the first valve orifice, and means for furnishing liquid product from the container to the second valve orifice.

4. The valve unit of claim 1, and comprising means for furnishing liquid product from a container to the first valve orifice and means for furnishing propellant vapor from the container to the second valve orifice.

5. A valve unit for a pressurized aerosol dispenser having a container for containing under pressure a liquid product and a propellant, said unit comprising a valve housing which contains a single moveable valve body, and a single annular resilient valve gasket and a spring to bias the valve body upwardly toward closure, the valve body comprising a valve stem having a central passage surrounded by an annular passage and a neck of smaller diameter than said stem portion, said neck portion having a first transverse valve orifice in communication with said annular passage of the valve stem and a second transverse valve orifice remote from the first and in communication with the central passage of the valve stem, said neck portion being encompassed by the inner periphery of the annular gasket to close both valve orifices when the valve body is in the closed position and to be deflected away from both valve orifices when the body is depressed against the bias of the spring, and an impact mixing chamber connecting with said central and annular passages for mixing product and propellant.

6. A valve unit, having a valve body and an actuator mounted in reciprocal relation such that movement of one produces a corresponding movement of the other, for a pressurized spray dispenser having a container for holding under pressure both liquid product and propellant, said valve unit comprising a container closure element, a valve housing attached to the closure element, a gasket and a movable and retractable valve body within said valve housing, a valve stem associated with said valve body and having orifice means and dimensionally fixed conduit means for discharge of product and a gaseous propellant therethrough, a valve actuator and a product discharge orifice, in combination with venturi ejector means, said ejector means being disposed in a recess in the valve housing and a member having a central conduit extending through its length, said member having an upper portion shaped to friction fit into said recess in the bottom of the valve housing, the upper surface of said upper portion having an annular recess, an impact mixing chamber contiguous to the central conduit and transverse grooves extending from said annular recess to the mixing chamber, vertical conduit means defined by the inner wall of the recess in the bottom of the valve housing and the outer wall of the upper portion of the ejector, and extending to said annular recess, which conduit means provide a flow path for the gaseous propellant to the annular recess.

7. The valve unit of claim 6 wherein the member has a bottom portion and comprising a tube attached to the bottom portion for conveying liquid to the mixing chamber.

8. The valve unit of claim 6, wherein the valve stem has a plurality of conduit means and including second venturi ejector means in communication with the conduits of the valve stem and in proximate relation to the discharge orifice.

9. The valve unit of claim 6, wherein the top surface of the ejector member has a plurality of transverse grooves equidistant from each other which are disposed relative to the mixing chamber such that an inner portion of the transverse groove is aligned to intercept an outer portion of the chamber.

10. The valve unit of claim 6, wherein there are at least two transverse grooves and the number of vertical grooves defined by the recess in the bottom of the valve housing and the ejector member equals the number of transverse grooves.

11. A pressurized spray dispenser comprising a container for containing under pressure a liquid product and propellant and a valve unit, said valve unit comprising:

a container closure element, a valve housing attached to the closure element, a gasket and a movable and retractable valve body within said valve housing, a valve stem associated with said valve body and having orifice means and conduit means for discharge of product ang gaseous propellant therethrough, a valve actuator, a product discharge orifice, and venturi ejector means disposed in the valve housing, said ejector means being disposed in a recess in the valve housing, comprising a member having a central conduit extending through its length, said member having an upper portion shaped to friction fit into the recess of the valve housing, the upper surface of said upper portion having an annular recess, an impact mixing chamber contiguous to the central conduit and transverse grooves extending from said annular recess to the mixing chamber, vertical conduit means defined by the inner wall of the recess in the bottom of the valve housing and the outer wall of the upper portion of the ejector, and extending to said annular recess which conduit means provide a flow path for the gaseous propellant to the annular recess.

12. The spray dispenser of claim 11 wherein the member has a bottom portion and comprising a tube attached to the bottom portion for conveying liquid to the mixing chamber.

13. The spray dispenser of claim 11, and further including second venturi ejector means in communication with the discharge conduits of the valve stem and in proximate relation to the discharge orifice.

14. The spray dispenser of claim 11, wherein the top surface of the ejector member has a plurality of transverse grooves equidistant from each other which are disposed relative to the mixing chamber such that an inner portion of the transverse groove is aligned to intercept an outer portion of the mixing chamber.

15. The spray dispenser of claim 11, wherein there are at least two transverse grooves and the number of vertical conduit means defined by the wall of the recess in the bottom of the valve housing and the wall of the ejector member equals the number of transverse grooves.

16. A valve unit for a pressurized spray dispenser having a container for holding liquid product and propellant under pressure, said valve unit comprising a valve actuator having a discharge orifice, a valve housing having a bottom interior wall, a cut-out section in said bottom wall forming an impact mixing chamber, slots in said bottom wall extending outwardly from said cut-out section, an annular recess connected with said slots and openings in the outer vertical wall of said housing connecting to said annular recess, a central conduit extending through the bottom of said valve housing to said cut-out section and means for supplying propellant and product to said openings and central conduit, in combination with a plug having a central aperture communicating with said cut-out section in said valve housing, a spring forcing said plug against the bottom wall of the housing and means connecting the central aperture of said plug to said discharge orifice.

* * * * *